US009163855B2

(12) United States Patent
Akel

(10) Patent No.: US 9,163,855 B2
(45) Date of Patent: Oct. 20, 2015

(54) APPARATUS FOR INSTANTLY PREPARING HOT WATER

(76) Inventor: Dominique Akel, Paris (FR)

( * ) Notice: Subject to any disclaimer, the term of this patent is extended or adjusted under 35 U.S.C. 154(b) by 983 days.

(21) Appl. No.: 13/201,339

(22) PCT Filed: Feb. 18, 2010

(86) PCT No.: PCT/FR2010/050277

§ 371 (c)(1),
(2), (4) Date: Feb. 23, 2012

(87) PCT Pub. No.: WO2010/094893

PCT Pub. Date: Aug. 26, 2010

(65) Prior Publication Data

US 2012/0138598 A1 Jun. 7, 2012

(30) Foreign Application Priority Data

Feb. 18, 2009 (FR) ..... 09 51046
Feb. 18, 2010 (FR) ..... 10 51163

(51) Int. Cl.

| | |
|---|---|
| ***H05B 6/36*** | (2006.01) |
| ***C02F 1/48*** | (2006.01) |
| ***F24H 1/10*** | (2006.01) |
| ***F24D 17/00*** | (2006.01) |

(52) U.S. Cl.

CPC ..... *F24H 1/106* (2013.01); *F24D 17/00* (2013.01)

(58) Field of Classification Search

CPC ..... B01J 19/087; B01J 2219/0852; B01J 2219/0867; B01J 2219/0854; C02F 1/481; F24H 1/106; F24D 17/00

USPC ..... 219/629, 630, 660, 676; 210/695, 222, 210/251, 758, 138, 223

See application file for complete search history.

(56) References Cited

U.S. PATENT DOCUMENTS 5,061,835 A * 10/1991 Iguchi ..... 219/630
5,074,998 A * 12/1991 De Baat Doelman ..... 210/97
5,171,431 A * 12/1992 Schulte ..... 210/94
5,216,215 A 6/1993 Walker et al.

(Continued)

FOREIGN PATENT DOCUMENTS

EP 0357102 A2 3/1990
EP 1686329 A2 8/2006

(Continued)

OTHER PUBLICATIONS

International Search Report published Oct. 14, 2010 as WO2010/094893A3 of the parent International Application No. PCT/FR2010/050277.

(Continued)

*Primary Examiner* — Quang Van
(74) *Attorney, Agent, or Firm* — Faegre Baker Daniels LLP

(57) ABSTRACT

The invention relates to an apparatus including an induction device (110) for heating water in a channel and supplied by a high-frequency generator (113), and an electromagnetic scale-preventative device (120) upstream from the heating circuit (110) and powered by a frequency generator (113). A channel sensor (130) detects a request for water and a control circuit (150) receives the water request signal (Sec) from the sensor (130) so as to control the operation of the heating circuit (110) and of the scale-preventative device (120), adjusting the power thereof in order to adjust the temperature and to stop the operation thereof.

10 Claims, 5 Drawing Sheets

(56) References Cited

U.S. PATENT DOCUMENTS

| | | | | |
|---|---|---|---|---|
| 5,262,621 | A | 11/1993 | Hu et al. | |
| 2012/0138598 | A1 | 6/2012 | Akel | |
| 2013/0118987 | A1 * | 5/2013 | VerMurlen et al. | 210/696 |

FOREIGN PATENT DOCUMENTS

| | | | |
|---|---|---|---|
| FR | 2544472 | A1 | 10/1984 |
| FR | 2685760 | A3 | 7/1993 |
| FR | 2697537 | A1 | 5/1994 |
| GB | 1029567 | A | 5/1966 |
| WO | WO2010094893 | A2 | 8/2010 |

OTHER PUBLICATIONS

Written Opinion mailed Aug. 18, 2011 from the Internatioanl Searching Authority in parent International Application No. PCT/FR2010/050277 and its English translation.

IPRP mailed Aug. 23, 2011 from the Internatioanl Searching Authority in parent International Application No. PCT/FR2010/050277 and its English translation.

* cited by examiner

APPARATUS FOR INSTANTLY PREPARING HOT WATER

FIELD OF THE INVENTION

The present invention relates to an installation for the instantaneous preparation of hot water which is intended to be connected directly upstream of a station for using hot water (wash basin, sink, washing machine), with a water supply connection and a water outlet connection comprising:

an induction device for heating passing water comprising a heating circuit which is provided with an inductor which is supplied with electrical power by a high-frequency generator.

PRIOR ART

There are electrical devices for instantaneously heating sanitary hot water which are provided in wash basins, hand washers or sinks in order to directly provide hot water, generally sanitary hot water, at the point of use.

Electrical water heaters which are referred to as "instantaneous" and which are provided at points of use such as wash basins or sinks are small storage water heaters which allows them to be readily integrated close to the point of use and allows the provision of hot water at the conventional temperature of sanitary hot water for small quantities, without the device having great electrical power, requiring the costly installation of an appropriate cable.

In the case of electrical household equipment such as washing machines or dishwashers, the devices are supplied with cold water which is directly heated in the vessel of the device by a resistor.

In general, finally, there are electrical storage water heater installations which have a number of disadvantages, in terms of production, cost and operation. The water heaters are often far from the points of use so that, in order to have hot water at the desired temperature, it is necessary to wait for cold water to empty from the pipes before receiving hot water. These electrical water heaters must be maintained at a temperature of from 65 to 70° in order to prevent the formation of bacteria as has been found over recent years and, when the water is used at a temperature lower than that of the storage device, which is generally or often the case, it is necessary to add cold water to mix and lower the temperature of the water which corresponds to a loss of energy by heating the water.

In electrical storage heaters, as also in devices such as dishwashers or washing machines, scale accumulates on the resistor which must be regularly replaced by a specialist.

There are induction water heaters which are used to provide hot water which is adjusted to a precise temperature, for sanitary uses or eater heaters which provide a precise measure of hot water at a specific temperature for food preparation.

In this manner:

Document PR 2 544 172 describes an induction water heater with electromagnetic control which comprises an induction heating member through which the cold water to be heated passes. The water heater comprises at the inlet a dual solenoid valve supplying either the heating member or the outlet tap directly. The operation of the water heater and the distribution of water are carried out using a control panel which comprises a cold water call button, a hot water call button, buttons for controlling the temperature of the hot water and a button for stopping the high frequency generator.

The user must first call for not water or cold water via the control panel, the tap simply allowing him to adjust the flow of water at the outlet without controlling the start and the stop of the water heater. This operation can only be initiated by previously activating the cold water call batten or hot water call button and, in the case of hot water, by adjusting the temperature with respect to the temperature first displayed, which is that of the water at the inlet of the heating member.

This is therefore a relatively complex operation for an installation which is itself complex. This water heater cannot be operated by simply manipulating the drawing tap.

Document FR 2 635 760 relates to a device for distributing instantaneous hot water, which provides small measures of hot water at a preadjusted temperature and which is used to dissolve food powder such as coffee powder in order to produce a hot drink.

This device comprises a water tank iron which the small measure of water which must be heated is removed. The problem addressed by this device is that of providing water which is immediately at the desired temperature without the temperature of the water provided progressively rising, for example, from ambient temperature to the final temperature; this being necessary so that the measure of water removed is uniformly at the necessary temperature.

To this end, the device is controlled using a handle which simulates the drawing action of the measure of hot water by beginning the heating action. However, the dispensing of the water is timed until the measure removed from the tank is heated to the correct temperature by the induction heating device. Only at this time does the valve release the measure of hot water.

Such an induction hot water device cannot constitute a source of sanitary of water which is intended to continuously supply a drawing point, such as a wash basin or an electrical household device which operates with hot water.

OBJECT OF THE INVENTION

The object of the present invention is to develop an installation for the instantaneous preparation of hot water which can be readily installed and which is simple and efficient to produce for providing hot water whilst preventing the deposit of scale and its consequences.

Statement and Advantages of the Invention

To this end, the present invention relates to an installation of the type defined above, characterised in that it comprises:

A) an electromagnetic anti-scale device which is upstream of the heating circuit and which is supplied with electrical power by a frequency generator, B) a passage sensor which detects a requirement for hot water by the opening of a tap or a valve in the region of the station for use or the stopping of the request, C) a branch conduit downstream of the anti-scale device, which branch is provided with a sensor for the passage of water which provides a cold water request signal, D) a control circuit which receives, on the one hand, the hot water request signal (Sec) from the passage sensor in order to control the operation of the heating circuit and the anti-scale device, to adjust the power supplied to the heating device in order to control the temperature thereof and to stop their operation and, on the other hand, the signal oh the water passage sensor in order to control the operation of the anti-scale device without operating the water heating device.

The installation for the instantaneous preparation of hot water by means of induction according to the invention affords the advantage of being an installation which is particularly simple to produce and operate and which allows a variety of applications. The operation of the installation is almost automatic. After the reference temperature has been adjusted as with an electrical water heater, the device functions automatically by simply opening the drawing tap and stops when it is closed. The installation has the advantage of combining the passage of cold waiter and that of the water to be heated through the anti-scale device, so that the same particularly simple installation device which requires only connection to the inlet pipe and connection to the outlet pipe(s) (hot wafer and if necessary cold water), and the electrical connection, can thus be mounted in the immediate vicinity of the point of use. Since sanitary hot water is not necessarily required at an extremely precise temperature, but instead at the conventional temperature of sanitary hot water, it is of little relevance whether the water is immediately at the reference temperature as soon as it arrives or whether it changes progressively but very rapidly to this temperature, particularly since there is the inevitable dead space between the installation for preparing hot water and the outlet of the drawing tap. The simplicity of the design, the production and the use of this installation is largely linked to the passage sensors which detect the requirement for hot water and the requirement for cold water.

These passage sensors are integrated in the installation and do not have to be installed at the drawing point (hot water tap, cold water tap or mixer). Only the flow of water requested is detected by the passage sensor.

Using these simple sensors, the operation or non-operation of the heating means is controlled in an efficient manner with, in each case, passage into the anti-scale device.

The installation for instantaneous preparation of hot water can be readily mounted in the supply pipe of a water point such as the pipe which is connected to a wash basin mixer or to the hot water tap, for example, branched from the cold water pipe, particularly since the upstream branch and the downstream branch of the installation can be connected to the supply pipe and to the it pipe of the station for use via flexible pipes in order to make best use of the often very small space available in the region of the station for use, below the wash basin or the sink or in the washing machine or dishwasher. Since this installation constitutes a unit which only requires the connection of the water supply and the water outlet and the electrical power supply, in the event, of a malfunction, the installation can be readily and simply disassembled in order to be very rapidly replaced by another installation of the same type.

The processing of the water by the anti-scale device upstream of the water heating circuit prevents scale from being deposited at that location and, in the case of an installation which also comprises a cold water outlet branched from the conduit downstream of the anti-scale device and upstream of the water heating device, the deposit of scale is prevented in this portion of the conduit and at the point of use.

The electrical, energy consumption of the installation is very low since there is no loss linked to the storage of hot water, the heating of the water being almost instantaneous and being carried out by means of passage; the water heating circuit which is advantageously sized in accordance with the anticipated flow, allows hot water to be provided that is heated by means of induction, at the correct temperature and in an almost instantaneous manner. The closure of the tap or the hot water drawing valve or flap is automatically detected by the passage detector which controls the stooping of the heating of the water and the anti-scale processing device and also constitutes a safety mechanism.

According to another advantageous feature, the water heating circuit with its inductor and the anti-scale device are accommodated in a casing which is connected to an electrical casing which comprises the generator which supplies electrical power to the inductor of the heating circuit, the generator of the anti-scale device and the control circuit. The separation between the elements directly installed in the passage of the water and the electrical and electronic means which supply and control these elements in a different casing affords greater flexibility terms of positioning in order to take into account specific constraints in terms of particular spatial requirements.

According to another advantageous feature, the installation comprises a casing which is provided with an upstream connection and a downstream connection in order to connect the installation to the water pipe which supplies be station for use and a terminal block for connecting the electrical line. If necessary, there is also provided a cold water outlet which will be passed only in the anti-scale device.

In this instance, the installation constitutes a practically closed assembly the only accessible members of which are the control elements such as a button for controlling temperature and a start/stop button; the casing is installed in its existing state in the supply pipe of the station for use, for example, directly below the wash basin, or at the side of the shower or below a sink and/or in a washing machine or dishwasher. It is simply necessary to carry out three connections: the upstream connection for the supply, the downstream connection for the water outlet thereof and the electrical connection.

According to another advantageous feature, the heating circuit is a circuit selected from the following, circuits:

- a serpentine member of ferromagnetic material,
- a serpentine member of ferromagnetic material contact with a plate of ferromagnetic material,
- a sheet of water defined between two plates of ferromagnetic material,
- a serpentine member of non-ferromagnetic material in contact with one or two plates of ferromagnetic material.

The heating circuit in its various embodiments is directly connected to the cold water supply so that the heating circuit is always filled with water and, as soon as the high-frequency generator is started, the induction can heat the water in the heating circuit.

The various embodiments of the heating circuit in the form of a serpentine member of ferromagnetic material or in contact with a ferromagnetic material which constitutes the inductor which will be heated by the Foucault currents induced by the inductor efficiently provide the heating directly and/or by means of conduction.

According to one advantageous feature, the heating circuit is accommodated in a casing and the free space between the heating circuit and the casing is filled with a loose ferromagnetic material. The ferromagnetic material is thus directly in contact with a significant surface-area of the serpentine member or plates which may or may not be of a ferromagnetic material, so that the passage of the heat by means of conduction is extremely efficient.

According to one variant, the loose ferromagnetic material is further immersed in a heat-exchange liquid which further improves the heat conduction.

According to another feature, the heating circuit is constituted by a casing which houses an insert of ferromagnetic material which is exposed to the high-frequency ferromagnetic field of the inductor.

The casing in which the insert is accommodated is preferably of a non-ferromagnetic material, for example, copper or aluminium.

According to particularly advantageous embodiments, the insert is an element selected from the group comprising:

a plate which is provided with vanes on one face, a plate which is provided with vanes on both faces thereof, a dual plate which is connected by vanes, an assembly of parallel plates which define sheets of water.

The insert thus produced has the advantage of being heated directly by means of induction and of exchanging heat with the medium in which it is immersed, that is to say, the water to be heated. The heat conduction and generally heat exchange is carried out in a particularly effective manner owing to the channel-like shapes defined by the plate, the vanes and the chamber formed by the casing, so that the water to be reheated is effectively distributed between the various channels and is in the form of narrow streams which can be heated in a particularly effective manner.

According to another feature, the casing is composed of a non-ferromagnetic metal, such as copper or aluminium.

According to one variant, the control circuit is provided with an infrared receiver IR or radiofrequency receiver RF in order to be controlled by signals from an infrared transmitter IR Or radiofrequency transmitter RF which allows the temperature of the water to be controlled remotely without direct intervention in the casing. This solution may be used in addition to the control button with which the control casing is provided.

DRAWINGS

The present invention will be described in greater detail below with reference to the appended drawings, in which:

FIG. 1 is a diagram of an embodiment of an installation for the instantaneous preparation of hot water according to the invention, and FIG. 2 is a diagram of a production variant of the installation for the instantaneous preparation of hot water according to the invention, FIG. 3 is a schematic, perspective view of a first embodiment of a heating device, FIG. 4 is a schematic, perspective view of a second embodiment of a heating device, FIGS. 5A, 5B, 5C, 5D are schematic views of different types of insert for a heating device, that is to say:

FIG. 5A is a perspective view of a simple insert having vanes,

FIG. 5B is a horizontal sectioned view of an insert having vanes on the two faces thereof placed in a easing, FIG. 5C is a horizontal sectioned view of an insert formed by two plates which are connected by vanes which delimit channels, FIG. 5D is a horizontal cress-section of an insert formed by an assembly of plates which together delimit sheets of water, FIG. 6 is a schematic, perspective view of another production variant of the heating device forming a serpentine path for the flow of water, FIGS. 7A, 7B illustrate another embodiment of a heating device formed by a conduit which is wound in a helical manner, in which:

DESCRIPTION OF THE EMBODIMENTS

Figure 1:
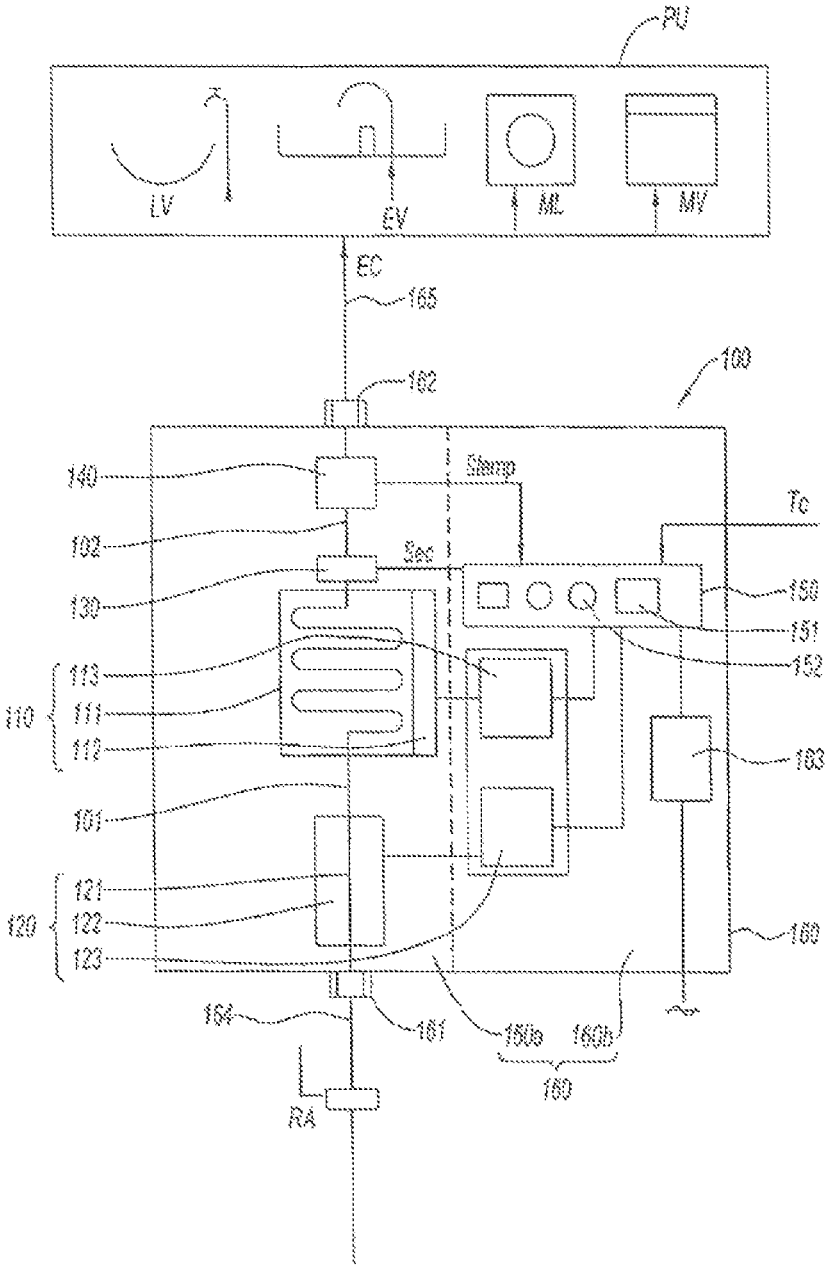

According to FIG. 1, the installation 100 for the instantaneous preparation of hot water, in particular sanitary hot water, is intended to be directly connected upstream of a station for use PU or therein. The station for use PU is a wash basin or hand washer LV, a sink EV, a washing machine ML or a dishwasher MV. The various stations for use consume hot water at specific temperatures, suitable for their operation.

The installation 100 is composed of a device 110 for heating passing water, through which the stream 101 of water to be heated passes. It comprises a heating circuit 111 which is provided with an inductor 112 which is supplied with electrical power by a high-frequency generator 113.

The circuit 111 is sufficiently long to heat water during its passage in the circuit exposed to the inductor 112. The circuit 111 and the inductor 112 are sized in accordance with mean parameters such as the mean flow rate of water, its variation in a flow rate range and a temperature range in order to optimise the electrical power installed.

The heating circuit 111 is preceded in an upstream direction in accordance with the passage direction of the water to be heated by an anti-scale electromagnetic device 120 which generates a variable electromagnetic field in order to modify the stereochemical structure of the calcium carbonate contained in the water in order to prevent it being deposited in the form of scale. The anti-scale device 120 comprises a generator 123 which provides an electrical signal which supplies electrical energy to the electromagnetic system which generates the electromagnetic field 122 which is applied to the water which passes in the conduit 121.

The installation also comprises a water passage sensor 130 which provides a signal Sec in accordance with the passage of water into the installation, that is to say, depending on whether the water is flowing or is stopped and preferably also in accordance with the flow rate of water. The water passage sensor 130 is a pressure sensor which is connected to the water conduit 102 which extends in the casing 160 and which detects the variation of pressure when the drawing tap of the point of use PU is opened and closed or a sensor which is associated with a diaphragm which is mounted in the conduit and which provides a signal which represents not only a flow of water (passage of water/stopping of the passage of water) but also the magnitude of the flow in order to adjust the power provided to the heating device 110.

The water passage sensor 130 is advantageously combined with a temperature sensor 140 which detects the temperature of the water at the outlet of the installation 100 in order to control the electrical power provided to a reference temperature Tc, regardless of the flow of water drawn in.

The induction heating device 110, the anti-scale device 120 and the water passage sensor 130 and the temperature sensor 140 are connected to a control circuit 150 which controls the operation of the installation 100 in accordance with the hot water requirement (hot water requirement, stoppage, reference temperature of the hot water).

The control circuit 150 contains the operating program with the adjustable parameters whose value is adjusted when the installation is positioned in accordance with general characteristics or in accordance with the specific operation required.

In the case of a wash basin LV, the temperature of the water provided will be lower than the temperature of from 65 to 70° C. imposed on conventional water heaters with a of water reserve; it will be able to be at the temperature for use without requiring metering with cold water, for example, a temperature of from 40 to 50° C.

In the case of a sink EV, the reference temperature will be able to be higher than that of the hot water which is supplied to a wash basin.

For a washing device such as a dishwasher MV or a washing machine ML, the reference temperature will be given by the washing program and, if necessary, in accordance with the mass of products to be washed, in accordance with a signal provided by the washing machine and/or the signal from a temperature sensor which is installed in the vessel of the machine and which measures the progression of the temperature of the water during filling for even more precise adaptation to the ideal operating conditions of the machine and in order to optimise the consumption of electrical energy.

The installation 100 is preferably accommodated in a single casing 160 which comprises only a water inlet 161, a water outlet 162 and an electrical connection 163 which allows only the control members 151, 152 of the control circuit 160 to be seen at the front of the casing.

The installation 100 is advantageously positioned downstream of the stop tap RA with which the point of use PU is provided and the connection is carried out either on the rigid pipe or, more advantageously, via flexible pipes 164, 165 which connect the cold water inlet 161 to the water supply nine and the hot water outlet 162 to the inlet EC of the point of use PU.

According to a variant, the installation is distributed over two casings 160*a*, 160*b*, one of them accommodating the water heating circuit 111, the anti-scale device 120, the passage sensor 130 and the temperature sensor 140; the other portion 160*b* accommodates the power generators 113, 123 which supply electrical power to the two devices and the control circuit 150 in order to be able to better adapt the assembly of the installation 100 to specific conditions in terms of spatial requirement.

Figure 2:
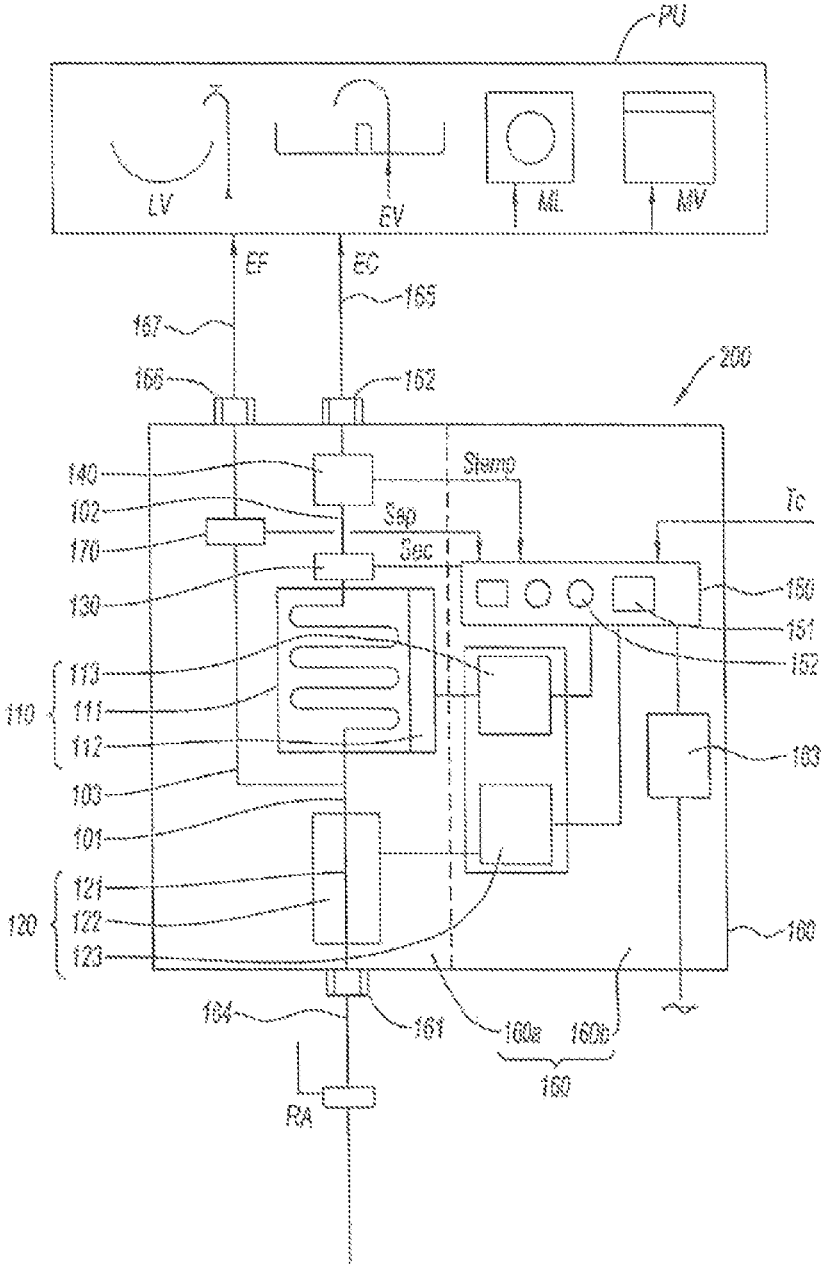

FIG. 2 illustrates an installation 200 which is a variant of the installation 100 of FIG. 1. This installation 200 practically comprises the same elements as those of the installation 100 and these elements have the same reference numerals so that they will not be described again.

This variant 200 differs from the one above owing to a branch 103 which is provided downstream of the anti-scale device 120 and which terminates directly at the cold water outlet 166 which is connected via a conduit 167 to the cold water inlet SF of the station for use PU, at the same time as the supply of hot water EC arriving from the conduit 165.

This conduit 103 is provided with a water passage sensor 170 which provides a cold water request signal Sef which is transmitted to the control circuit 150 in order to operate the anti-scale device 120 but not the water heating device 110.

The water heating device 110 can be started only by the signal Sec sent by the water passage sensor 130.

According to variants which are not illustrated, the water heating circuit can be constituted by a serpentine member which may be provided with conductive plates, heated by the inductor 112 in order to be the serpentine member and the water. It is also possible to produce a heating circuit 111 which is constituted by two plates which delimit a small gap for the passage of water, the plates being heated by the inductor 112 in order to heat the water which passes between the plates by means of conduction.

Other types of water heating devices 110 will be described with reference to FIGS. 3 to 7B.

Figure 3:
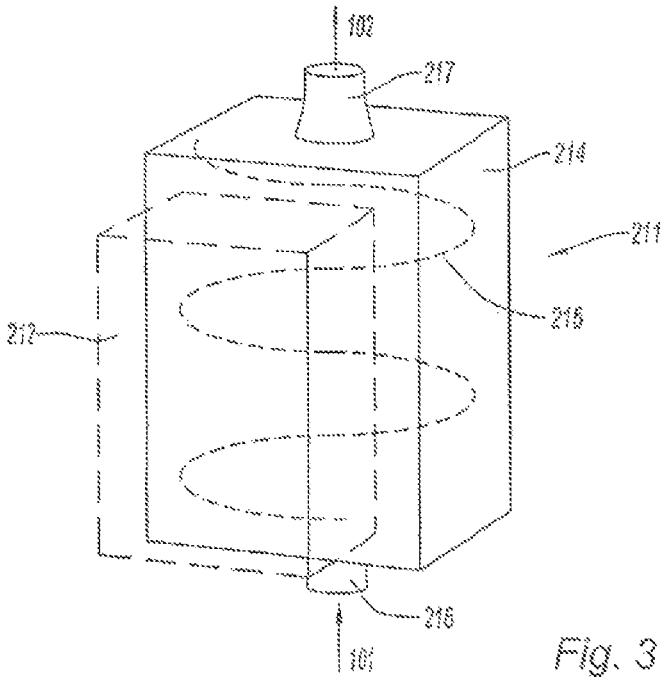

According to FIG. 3, the circuit 211 for heating passing water is composed of a chamber in the form of a casing 214 of a ferromagnetic material which accommodates a serpentine member 215 which is connected via an inlet connection 216 and an outlet connection 217 to the conduits 101, 102. The inductor 212 is pressed against one of the faces of the casing 214.

The serpentine member 215 accommodated in the casing 214 is in thermal contact with the faces of the casing. The space of the casing may further contain a loose ferromagnetic, material in the state of balls or grains, if necessary, with a filling of heat-exchange liquid in order to release the heat directly in contact with the serpentine member. This will thus be heated via its contact with the faces of the casing and the material which fills the space between the serpentine member 215 and the casing 214.

According to a variant which is not illustrated, the casing is of a non-ferromagnetic material and only the mass of loose material in the form of grains or balls directly in contact with the serpentine member is composed of a ferromagnetic material.

The serpentine member 215 is preferably produced from copper, in the same manner as the other conduits 101, 102 of the installation.

Figure 4:
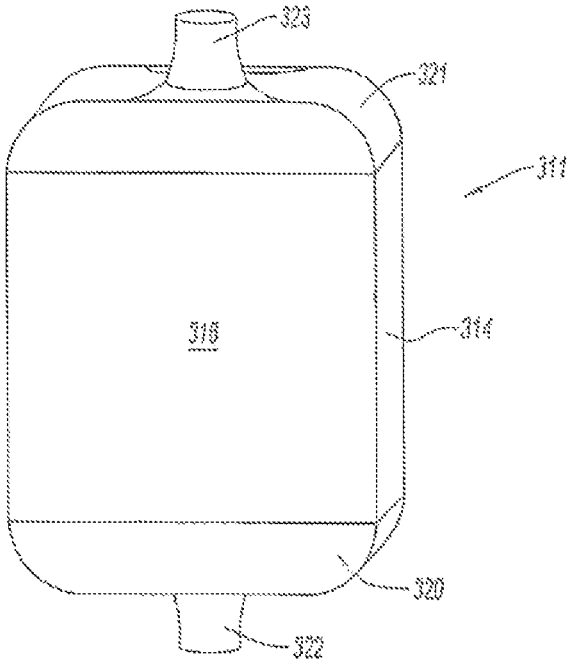

FIG. 4 illustrates a passage heating device 311 comprising a casing 314 which is provided with an inlet collector 320 and an outlet collector 321 which are connected via an inlet connector 322 and an outlet connector 323 to the conduits 101, 102, respectively.

The inlet collector 320 supplies the space 316 of the casing containing an insert and the outlet collector receives the heated water which has passed through this space.

The insert which does not appear in this Figure is a component of a ferromagnetic metal whilst the casing 314 may be of copper or aluminium or an alloy of aluminium, preferably coated externally with a thermal insulator.

The inductor is not illustrated in this Figure.

Various examples of an insert are illustrated in FIGS. 5A-5D. These inserts are placed in a space like the space 316 of the casing 314 of FIG. 4. This space generally comprises an inlet collector and an outlet collector which are not illustrated.

Figure 5A:
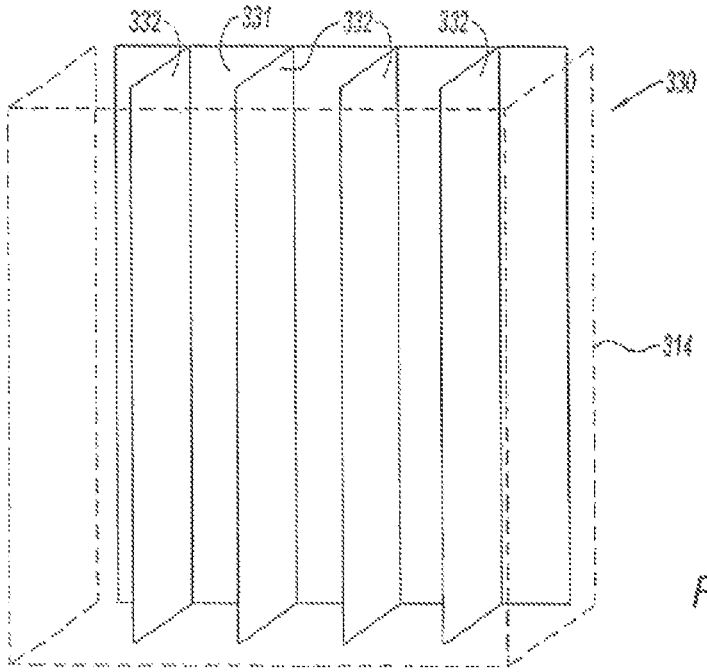

FIG. 5A illustrates an insert 330 formed by a plate 331 which is provided with vanes 332 on one face. All the members are of ferromagnetic material. The plate 331 and the vanes 332 form channels with the walls of the casing 314 delineated by the contour of broken lines into which streams of water pass and are heated by means of conduction in contact with the wall and the vanes.

Figure 5B:
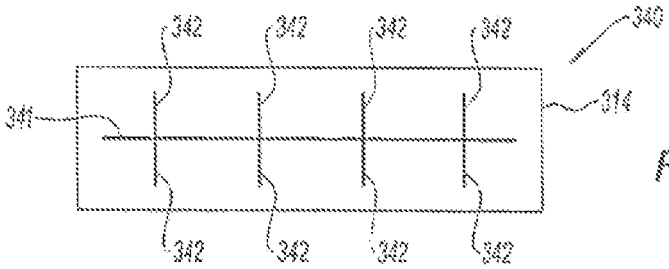

FIG. 5B is a horizontal sectioned view of an insert 340 in the form of a plate 341 which is bounded at the two faces thereof by vanes 342 which delimit channels with the casing 314. Channels of water which are heated in contact with the insert 340 pass through these channels.

Figure 5C:
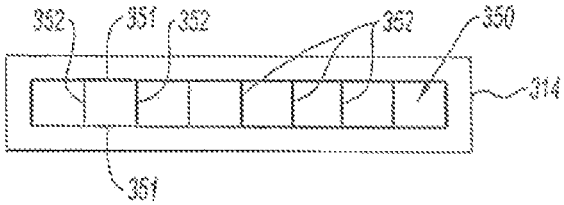

FIG. 5C illustrates another example of the insert 350 which is constituted by two plates 351 which are connected by partitions 352 in order to directly delimit channels. The outer faces of the plates 351 are at a specific distance from the walls of the space of the casing 314 and delimit externally sheets of water. Streams and sheets of water which are heated in contact with the insert pass through the assembly. The mixed structure thereof combines channels and sheets of water at the outer side of the channels.

Figure 5D:
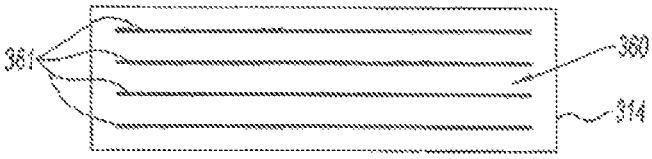

FIG. 5D illustrates another example of an insert 360 which is constituted by an assembly 361 of parallel plates of a ferromagnetic material, kept spaced apart from each other by means which are net illustrated, for example, by means of studs which are used to assemble the plates. The plates 361 delimit, with each other and with the walls of the casing 314, sheets of water.

Figure 6:
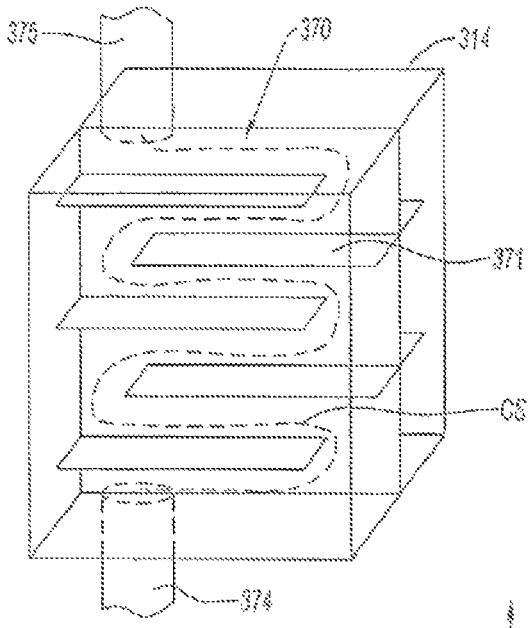

FIG. 6 is a schematic illustration of another example of the heating device constituted by an insert 370 of a ferromagnetic material which is provided on each face with horizontal vanes 371 which delimit a serpentine path (CS) between the inlet 374 at the lower portion and the outlet 375 at the upper portion. The casing 314 is preferably of a non ferromagnetic material and the insert 370 is of a ferromagnetic material. The casing 314 is provided with an inlet collector and an outlet collector, as in FIG. 4.

Figure 7A:
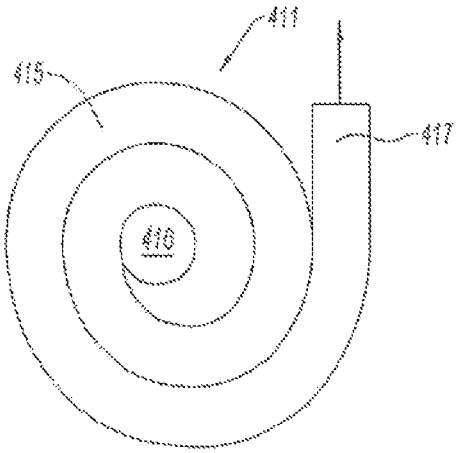
FIG. 7A is a front view of the heating device.
Figure 7B:
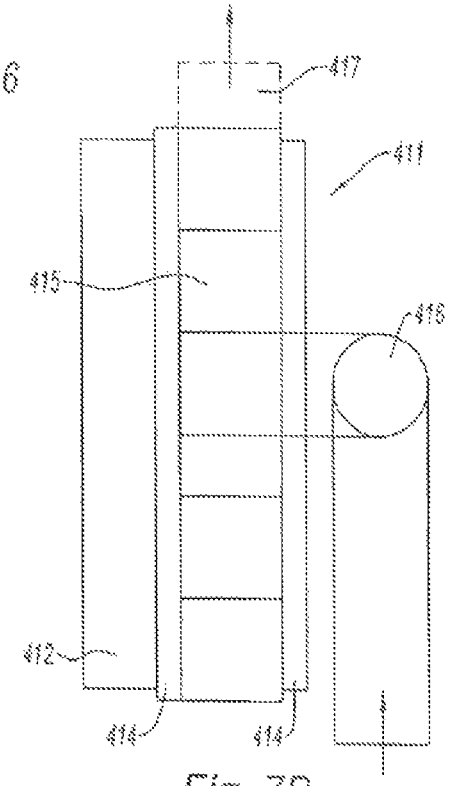
FIG. 7B is a sectioned view of the heating device.

FIGS. 7A, 7B illustrate another example of the water heating device. In this example, the water heating circuit 411 is constituted by a helical serpentine member 415. This is preferably a copper tube which is bent in order to form the helix with en inlet 416 at the centre and a tangential outlet 417. The helix 415 is provided on one face, and preferably on both faces, with a plate 414 of a ferromagnetic material and the inductor 412 is pressed against one of the faces. This helical shape has the advantage of being defined within a circle and thus being particularly well adapted to a planar, cylindrical, circular shape of the inductor 383.

In the example set out in FIGS. 7A, 7B, the heating circuit 411 formed by the serpentine member 415 is preferably a conduit having a rectangular or square cross-section which is bent and wound in the manner of a helix. According to one variant, this heating circuit may also be constituted by welded components, that is to say, two plates on the two faces and a strip which is wound in the manner of a helix and which defines the flow path of water between the two plates.

In the above description of various embodiments of heating circuits, the usual orientation is the vertical orientation, the cold water arriving via the bottom and the hot water leaving via the top, passing through the casing of the heating circuit, the channels and the sheets of water or the like almost vertically.

However, since the water is urged by the supply pressure, it may also have any orientation and in particular the channels and the sheets of water may be inclined or even horizontal.

The same applies to the heating circuit formed by the helical serpentine member which can be placed in a more or less vertical plane but also in a horizontal plane.

The latter case affords the advantage of reducing the height of the installation.

The installation for the instantaneous preparation of hot water according to the invention is provided with thermal insulation means around the device for heating passing water, and the water conduit at the outlet in order, on the one hand, to increase the efficiency of the heating and, on the other hand, to prevent the cold water conduit from becoming heated, these means not being illustrated. Finally, it should be noted that the pressure drops produced by the serpentine shape of the circuit produced by the shaped tube, or by vanes which constitute bends, or the helical shape, does not impair operation since the water is necessarily pushed through the heating circuit by its supply pressure. The passage of the water to be heated is carried out regularly over the entire cross-section of passage available and there is no fear of vapour pockets which could form at excess heating locations particularly since the circuit for heating passing water is composed either by a conduit with a small cross-section or several parallel conduits which form serpentine channels or paths through which the water is forced to pass under the action of its pressure.

According to a variant which is not illustrated, the cold water conduit 167 and the hot water conduit 165 are connected to a wash basin mixer LV or sink mixer EV.

According to another variant, in the case of a cold water supply and a hot water supply to a washing machine or dishwasher, the equipment comprises valves which are installed upstream of the hot water outlet 162 and cold water outlet 166 and which are controlled by the program of the washing machine ML or the dishwasher MV in accordance with the hot/cold water requirements required to carry out the washing program.

LIST OF REFERENCE NUMERALS

100, 200 Installation for the instantaneous preparation of hot water
101 Water conduit
102 Water conduit
103 Water conduit
110 Device for heating passing water
111 Circuit for heating passing water
112 Inductor
113 High-frequency generator
120 Anti-scale device
121 Conduit
122 Electromagnetic field generator
123 High-frequency generator
130 Water passage sensor
140 Temperature sensor
150 Control circuit
151, 152 Adjustment members
160 Casing
160, 160*a*, 160*b* Casing
161 Water inlet
162 Hot water outlet
163 Electrical connection
164 Water supply conduit
165 Hot water conduit
166 Cold water outlet
167 Cold water conduit
170 Water passage sensor
211 Circuit for heating passing water
212 Inductor
214 Casing
215 Serpentine member
216 Inlet connection of the casing
217 Outlet connection of the casing
311 Circuit for heating passing water
314 Casing
316 Space of casing containing an insert
320 Inlet collector
321 Outlet collector
322 Inlet connection
323 Outlet connection.
330 Insert
331 Plate
332 Vanes
340 Insert
341 Plate
342 Vanes
350 Insert
351 Plate
352 Partition
353 Casing
360 Insert
361 Parallel plate
363 Wall of casing
370 Insert
373 Casing
371 Horizontal vane
374 Inlet
375 Outlet
411 Circuit for heating passing water
412 Inductor
414 Plate
415 Helical conduit
416 Inlet
417 Tangential outlet
Tc Reference temperature PU Station for use
LV Wash basin
EV Sink
MV Dishwasher
ML Washing machine
RA Stop tap
EC Hot water
EF Cold water
Sec Hot water request signal
CS Serpentine path
Sef Cold water request signal

The invention claimed is:

1. An apparatus for the instantaneous preparation of hot water, for use in connection to a point of use for hot water, said apparatus comprising:

at least one water supply connection;

at least one water outlet connection;

an induction device for heating water, said induction device including a heating circuit provided with an inductor, said inductor supplied with electrical power by a first generator;

an electromagnetic anti-scale device upstream of said heating circuit, said electromagnetic anti-scale device supplied with electrical power by a second generator;

a first sensor operable to detect a requirement for hot water at the point of use, said first sensor operable to provide a water passage signal;

a branch conduit downstream of said anti-scale device, said branch conduit provided with a second sensor, said second sensor operable to provide a cold water request signal;

a control circuit operable to receive said water passage signal from said fist sensor to control operation of said heating circuit and said anti-scale device, to adjust power supplied to said heating device to control temperature of said heating device, and to stop operation of said heating device, said control circuit further operable receive said water request signal from said second sensor to control operation of said anti-scale device without operating said water heating device.

2. The apparatus of claim 1, wherein said inductor and said anti-scale device of said water heating circuit are housed in a first casing, said first casing connected to a second, electrical casing which includes said, first generator, said first generator supplying electrical power to said inductor of said heating circuit, said generator of said anti-scale device, and said control circuit.

3. The apparatus of claim 1, further comprising a casing which includes said water supply connection and said water outlet connection, said casing further including a terminal block for connecting an electrical line.

4. The apparatus of claim 1, wherein said heating circuit comprises at least one circuit selected from the group consisting of:

a serpentine member of ferromagnetic material;

a serpentine member of ferromagnetic material in contact with a plate of ferromagnetic material;

two plates of ferromagnetic material; and a serpentine member of non-ferromagnetic material in contact with at least one plate of ferromagnetic material.

5. The apparatus of claim 4, wherein said heating circuit is accommodated in a casing, and a free space between said heating circuit and said casing is filled with a loose ferromagnetic material.

6. The apparatus of claim 5, wherein said casing is formed of a non-ferromagnetic metal.

7. The apparatus of claim 1, wherein said heating circuit includes a casing, said casing housing an insert of ferromagnetic material exposed to a high-frequency ferromagnetic field of said inductor.

8. The apparatus of claim 7, where said insert includes at least one element selected from the group consisting of:

a plate including a face with vanes;

a plate including two faces with vanes;

a pair of plates connected by vanes; and an assembly of parallel plates.

9. The apparatus of claim 1, wherein said control circuit includes one of an IR receiver and an RF receiver which communicates with one of an IR transmitter and an RF transmitter to control a reference temperature.

10. The apparatus of claim 1, wherein at least one water outlet connection includes a solenoid valve, said solenoid valve controlled by the point of use in accordance with an operating program.

* * * * *

UNITED STATES PATENT AND TRADEMARK OFFICE

CERTIFICATE OF CORRECTION

PATENT NO. : 9,163,855 B2
APPLICATION NO. : 13/201339
DATED : October 20, 2015
INVENTOR(S) : Dominique Akel It is certified that error appears in the above-identified patent and that said Letters Patent is hereby corrected as shown below:

Claim 1, Column 11, Line 33, delete "fist" and insert --first--

Claim 1, Column 11, Line 38, after "control" insert --a--

Claim 1, Column 11, Line 35, after "operable" insert --to--

Claim 2, Column 12, Line 1, after "said" delete ","

Signed and Sealed this
Nineteenth Day of July, 2016

Michelle K. Lee

Michelle K. Lee
*Director of the United States Patent and Trademark Office*